US009631626B1

(12) United States Patent
Byrne et al.

(10) Patent No.: US 9,631,626 B1
(45) Date of Patent: Apr. 25, 2017

(54) SINGLE SCREW BLADE ARMS

(71) Applicants: Brendan Byrne, Germantown, TN (US); James Burns, Memphis, TN (US)

(72) Inventors: Brendan Byrne, Germantown, TN (US); James Burns, Memphis, TN (US)

(73) Assignee: HKC-US, LLC, Memphis, TN (US)

( * ) Notice: Subject to any disclaimer, the term of this patent is extended or adjusted under 35 U.S.C. 154(b) by 502 days.

(21) Appl. No.: 13/782,242

(22) Filed: Mar. 1, 2013

(51) Int. Cl.
*F04D 25/08* (2006.01)
*F04D 29/34* (2006.01)
*F04D 29/64* (2006.01)
*F04D 29/36* (2006.01)

(52) U.S. Cl.
CPC ..... *F04D 25/088* (2013.01); *F04D 29/34* (2013.01); *F04D 29/646* (2013.01); *F04D 29/36* (2013.01)

(58) Field of Classification Search
CPC ..... F04D 29/34; F04D 25/088; F04D 29/644; F04D 19/002; F04D 25/008; F04D 29/646; F04D 29/36
USPC .... 416/210 R, 131, 135, 207, 214 R, 219 R, 416/220 R, 238, 244 R, 5; 417/423.1, 417/423.14, 423.15, 424.1
See application file for complete search history.

(56) References Cited

U.S. PATENT DOCUMENTS 3,549,184 A 12/1970 Anderson
4,186,952 A 2/1980 Glass
4,331,413 A 5/1982 Hoen
4,420,859 A 12/1983 Hammerle
D382,955 S 8/1997 Liu
5,980,353 A * 11/1999 Wu ..... 416/210 R
6,042,339 A 3/2000 Blateri et al.
6,155,786 A * 12/2000 Blateri et al. ..... 416/206
D441,442 S 5/2001 Williams
6,241,475 B1 * 6/2001 Blateri ..... F04D 25/088 416/206
6,267,543 B1 7/2001 David
6,309,183 B1 * 10/2001 Bucher et al. ..... 416/210 R
6,352,409 B1 * 3/2002 Blateri et al. ..... 416/207
6,371,729 B1 * 4/2002 Tseng ..... F04D 29/34 416/210 R
6,585,488 B1 * 7/2003 Bucher et al. ..... 416/210 R
D478,382 S 8/2003 Burns
D482,774 S 11/2003 Stauffer
D483,465 S 12/2003 Tai
6,666,652 B2 12/2003 Bucher
D485,902 S 1/2004 Burns
6,758,626 B1 * 7/2004 Tseng ..... 403/408.1
6,863,499 B2 * 3/2005 Pearce ..... 416/210 R
(Continued)

OTHER PUBLICATIONS

Concord, Valore Quick Connect, Owners Manual and Installation Instructions. Model No. 52VALQC5E/CF52880-L, 2010 13 pages.
(Continued)

*Primary Examiner* — Alexander Comley

(57) ABSTRACT

Devices, systems and methods of using a single turning rotatable fastener, such as a screw, with two or three mounted posts to align and lock ceiling fan blades to a ceiling fan blade brackets/irons. One single rotatable fastener on each blade and arm can be turned clockwise to attach each blade to each arm. Rotating the fastener counterclockwise can allow each blade to be removed from each arm.

12 Claims, 17 Drawing Sheets

(56) References Cited

U.S. PATENT DOCUMENTS

| | | | | |
|---|---|---|---|---|
| 6,932,576 | B2 * | 8/2005 | Bird | F04D 29/34 416/206 |
| 6,935,842 | B2 | 8/2005 | Tai | |
| D531,305 | S | 10/2006 | Glasbrenner | |
| 7,163,377 | B2 | 1/2007 | Blateri et al. | |
| D539,894 | S | 4/2007 | Bucher | |
| 7,223,078 | B1 * | 5/2007 | Mares et al. | 416/210 R |
| D545,422 | S | 6/2007 | Glasbrenner | |
| D555,779 | S | 11/2007 | Bucher | |
| D556,886 | S | 12/2007 | Flores | |
| D565,168 | S | 3/2008 | Hidalgo | |
| D565,724 | S | 4/2008 | Hidalgo | |
| D568,983 | S * | 5/2008 | Pan | D23/411 |
| D573,245 | S | 7/2008 | Pan | |
| D578,636 | S | 10/2008 | Pan | |
| 7,527,478 | B2 | 5/2009 | Pearce | |
| D594,540 | S | 6/2009 | Pan | |
| D594,543 | S | 6/2009 | Pan | |
| D595,404 | S | 6/2009 | Pan | |
| D597,654 | S | 8/2009 | Orozco | |
| D599,470 | S | 9/2009 | Searle | |
| 7,762,782 | B2 | 7/2010 | Wang | |
| 7,775,771 | B2 | 8/2010 | Wang | |
| D626,210 | S | 10/2010 | Searle | |
| D626,213 | S | 10/2010 | Shurtleff | |
| D632,382 | S | 2/2011 | Pan | |
| 8,021,119 | B2 | 9/2011 | Wang | |
| D649,238 | S | 11/2011 | Passauer | |
| 8,356,979 | B2 | 1/2013 | Haynes | |
| D681,185 | S | 4/2013 | Passauer | |
| D710,492 | S | 8/2014 | Byrne et al. | |
| 8,985,959 | B1 | 3/2015 | Kuykendall et al. | |
| 2001/0046442 | A1 * | 11/2001 | Bucher et al. | 416/210 R |
| 2004/0219023 | A1 * | 11/2004 | Bird et al. | 416/210 R |
| 2005/0123403 | A1 * | 6/2005 | Tai | 416/210 R |
| 2006/0078431 | A1 * | 4/2006 | Blateri et al. | 416/210 R |
| 2006/0140770 | A1 * | 6/2006 | Liu | 416/210 R |
| 2008/0107529 | A1 * | 5/2008 | Friedman | 416/210 R |
| 2008/0273979 | A1 | 11/2008 | Bucher | |
| 2009/0004015 | A1 * | 1/2009 | Wang | 416/210 R |
| 2010/0284813 | A1 * | 11/2010 | Wang | 416/206 |

OTHER PUBLICATIONS

2013 Concord Fan Catalog. Luminance Company, pp. 1, 3 and 10, 2013, 3 pages, downloaded from web on Feb. 23, 2016.

Concord, 52" Valore Quick Connect, Model No. 52VALQ5EWH/CFS2880-30-L Ceiling Fan Box Pictures and Fan Blade and Arm pictures, purchased from Overstock.com on Jan. 14, 2016, 14 pages, purchased Jan. 14, 2016 from overstock.com.

* cited by examiner

SINGLE SCREW BLADE ARMS

CROSS REFERENCE TO RELATED APPLICATIONS

This Application is a Continuation-In-Part of U.S. patent application Ser. No. 13/459,568 filed Apr. 30, 2012, now U.S. Pat. No. 8,985,959, which claims the benefit of priority to U.S. Provisional Application 61/603,072 filed Feb. 24, 2012. The entire disclosure of each application listed in this paragraph are incorporated herein by specific reference thereto.

FIELD OF INVENTION

This invention relates blade connecting devices, and in particular to devices, systems and methods of using blade arm brackets/irons using only a single screw fastener with two or three mounted posts to align and lock ceiling fan blades to a ceiling fan blade brackets/irons.

BACKGROUND AND PRIOR ART

It is common to attach ceiling fan blades to blade brackets and holders of ceiling fans by screwing fasteners, such as screws, to attach the blades to ceiling fan brackets, where the brackets are attached to motors. Ceiling fan blades are difficult and tedious to assemble. Several small screws and washers need to be screwed through the blade and into the blade holder using a screw driver while holding the blade and blade holder in place.

Most ceiling fans require time and effort to assemble a blade with a blade holder. Many extra parts are needed and a tool is usually required for assembly. The hardware can be easily dropped, misplaced or lost.

Various types of alternatives have been proposed.

U.S. Pat. No. 6,758,626 to Tseng uses twistable knobs to attach blades in a ceiling fan. However, this device requires three twistable knobs, and that each of the knobs and their support posts must be oval shaped, and also requires keeping an air space between the blade and the arm in the locked position, which ends of with multiple parts and assembly time.

U.S. Pat. No. 6,932,576 to Bird shows and describes a connecting mechanism which uses one twisting knob. However, this device requires the installer to catch upwardly protruding inverted L shaped fasteners on a blade bracket to catch into holes in the blade. Next, a separated knob must be then inserted into another hole in the blade to be twisted. Having separated parts, such as the separate knob, can be easily lost and misplaced, similar to loose screws that are used to traditionally attach ceiling blades to ceiling fans. In addition, the catches can make it difficult for someone to angle the blade to assemble.

Thus, the need exists for solutions to the above problems with the prior art.

SUMMARY OF THE INVENTION

A primary objective of the present invention is to provide devices, systems and methods of using blade arm brackets/irons with a single screw fastener with two or three mounted posts to align and lock ceiling fan blades to a ceiling fan blade arm brackets/irons.

A secondary objective of the present invention is to provide devices, systems and methods of soundly connecting a blade to a blade holder without using more than one screw type fastener.

The novel invention device, system and method requires no tools, loose parts, or hardware. The blade is simply aligned and placed over the locating pins in the blade holder and locked into place by rotating the fastener.

The claimed invention differs from what currently exists. Our invention requires only one screw type fastener. The entire assembly process takes seconds compared to several minutes for other systems.

A ceiling fan blade arm, can consist essential of a blade attachment end having only one single rotatable fastener and at least two alignment posts, wherein the single screw and at least two alignment posts are adapted to pass into at least three through-holes on a root end of a blade in order to attach the blade to the arm.

The single rotatable fastener can be positioned in the middle of three posts, and the blade includes four through-holes. The rotatable fastener can be a screw.

Two posts can be positioned outward facing from the middle rotatable fastener on the blade attachment end of the blade arm and one post is positioned inward facing from the middle rotatable fastener.

Two posts can be positioned inward facing from the middle rotatable fastener on the blade attachment end of the blade arm and one post is positioned outward facing from the middle rotatable fastener.

Two posts can be positioned inward facing from the blade attachment end and the rotatable fastener is positioned outward facing, wherein the two posts and rotatable fastener form a triangular arrangement.

Two posts can be positioned outward facing from the blade attachment end and the rotatable fastener is positioned inward facing, wherein the two posts and rotatable fastener form a triangular arrangement.

A ceiling fan blade attachment system can include a plurality of blade arm, each blade arm consisting essentially of a blade attachment end having only one single rotatable fastener and at least two alignment posts, wherein the single screw and at least two alignment posts, and a plurality of fan blades, each blade having at least three through-holes on a root end of the blade, wherein the single rotatable fastener and the at least two alignment posts are adapted to pass into at least three through-holes on the root ends of a blades.

The single rotatable fastener on each arm can be positioned in the middle of three posts on each arm, and each blade includes four through-holes.

Two posts can be positioned outward facing from the middle rotatable fastener on each blade attachment end of the blade arm and one post is positioned inward facing from the middle rotatable fastener on each blade attachment end of each blade arm.

Two posts can be positioned inward facing from the middle rotatable fastener on each blade attachment end of the blade arm and one post is positioned outward facing from the middle rotatable fastener on each blade attachment end of each blade arm.

Two posts can be positioned inward facing from each blade attachment end and the rotatable fastener is positioned outward facing, wherein the two posts and rotatable fastener form a triangular arrangement on each blade attachment end of each blade arm, and each blade has only three through-holes on the root end of the blade.

Two posts can be positioned outward facing from each blade attachment end and the rotatable fastener is positioned inward facing, wherein the two posts and rotatable fastener form a triangular arrangement on each blade attachment end of each blade arm, and each blade has only three through-holes on the root end of the blade.

A method of attaching a ceiling fan blade to a motor arm with a single rotatable fastener, can include the steps of providing a blade having a root end with at least three through holes arranged in a triangular pattern, providing a blade arm having a blade attachment end with a single rotatable fastener and at least two posts, removing the rotatable fastener from the blade arm, aligning the at least three through-holes on the root end of the blade over the at least three through-holes on the blade attachment end of the arm, rotating the single rotatable fastener through a single through-hole in the blade attachment end of the arm to attach the blade to the blade arm, and repeating the above steps for attaching additional blades to the blade attachment arms on a ceiling fan.

The method can include the step of providing a single screw as the rotatable fastener to attach each blade to each blade arm.

Further objects and advantages of this invention will be apparent from the following detailed description of the presently preferred embodiments which are illustrated schematically in the accompanying drawings.

DESCRIPTION OF THE PREFERRED EMBODIMENTS

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

A listing of components will now be described.

Figure 1:
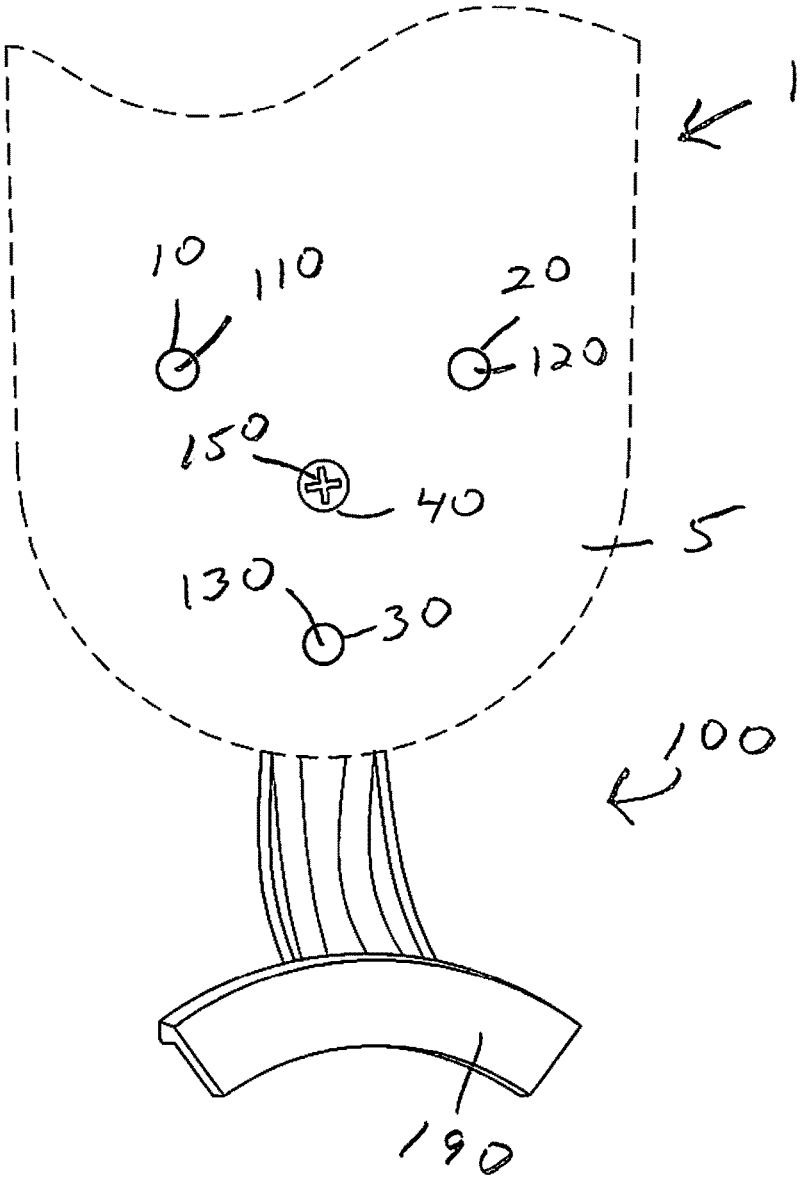
FIG. 1 is a plan view of a single rotatable fastener blade arm having two outward facing posts and one inward post with fan blade.
Figure 2:
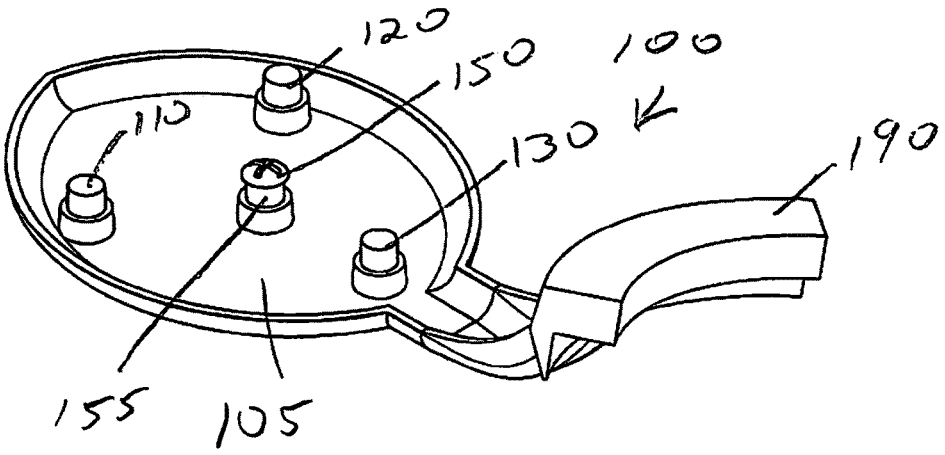
FIG. 2 is a top right perspective view of the arm of FIG. 1.
Figure 3:
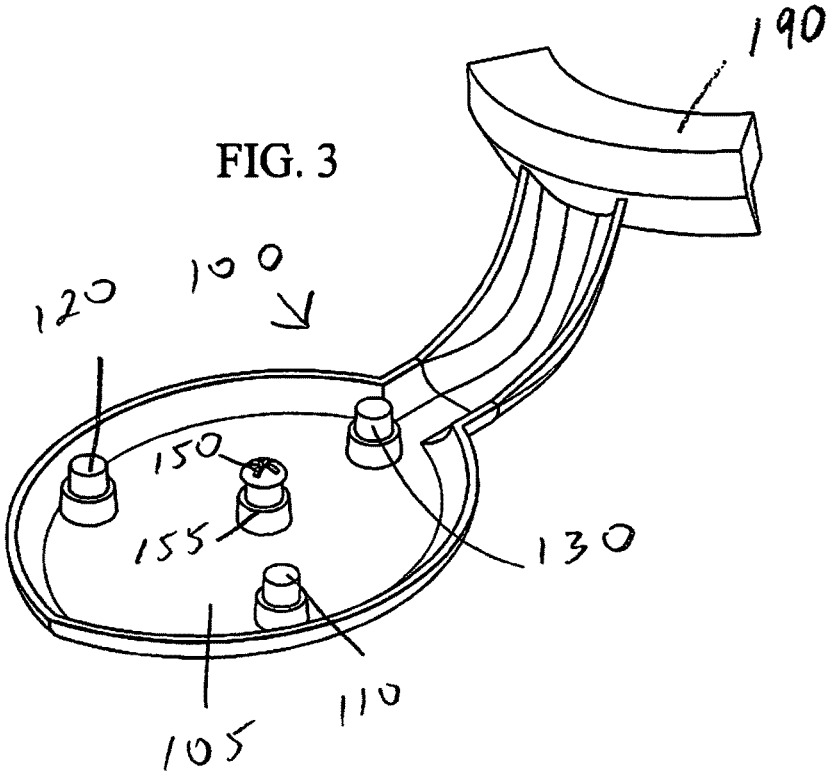
FIG. 3 is a top left perspective view of the arm of FIG. 1.
Figure 4:
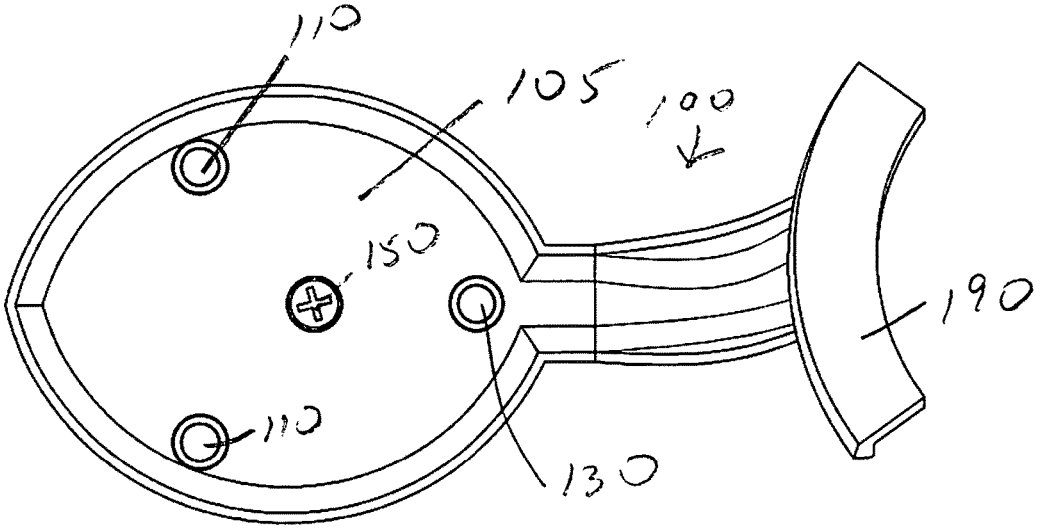
FIG. 4 is a top view of the arm of FIG. 1.
Figure 5:
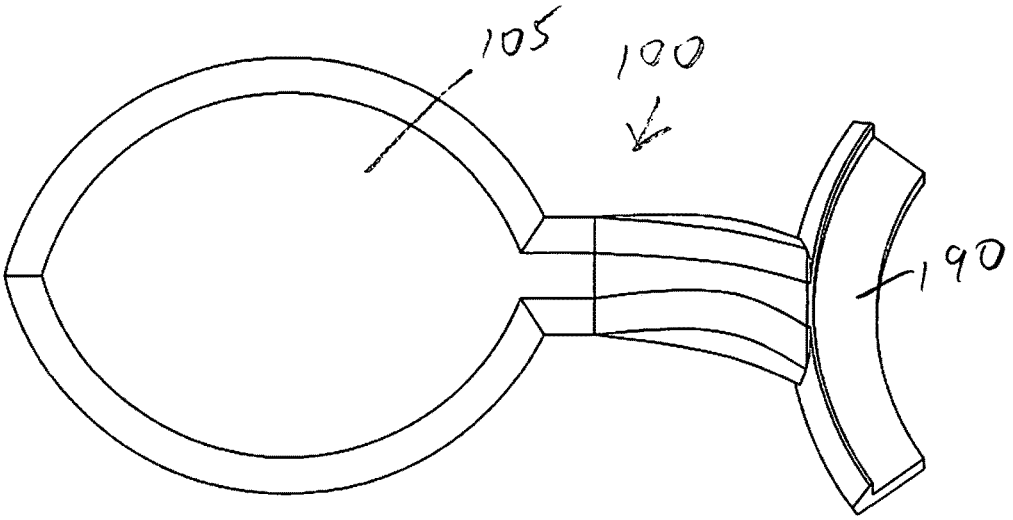
FIG. 5 is a bottom view of the arm of FIG. 1.
Figure 6:
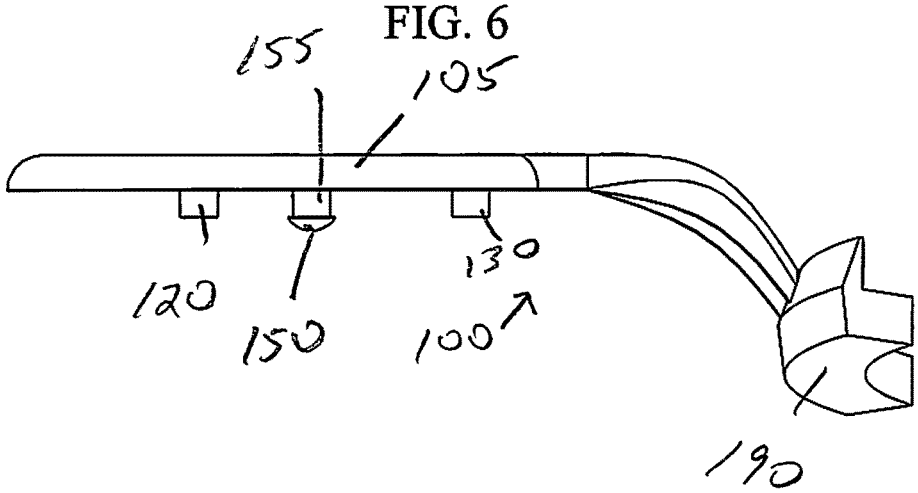
FIG. 6 is an upside down side view the arm of FIG. 1.
Figure 7:
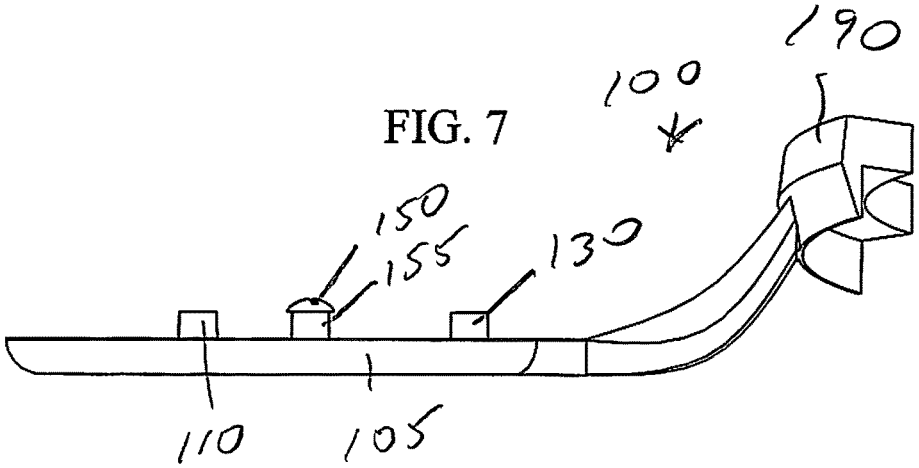
FIG. 7 is a side view of the arm of FIG. 1.
Figure 8:
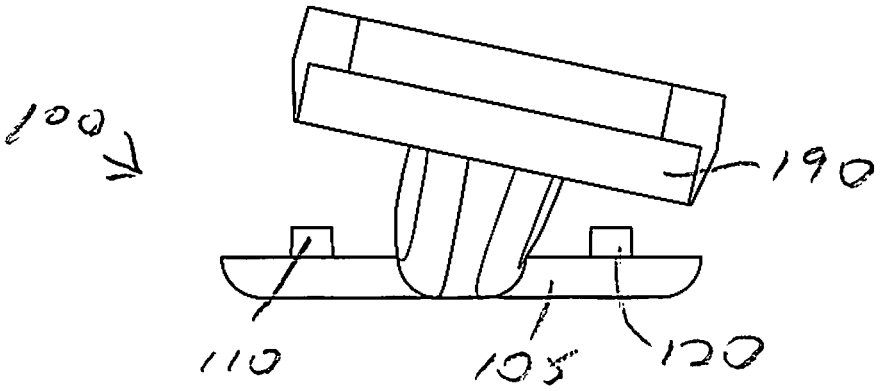
FIG. 8 is a root end view of the arm of FIG. 1.
Figure 9:
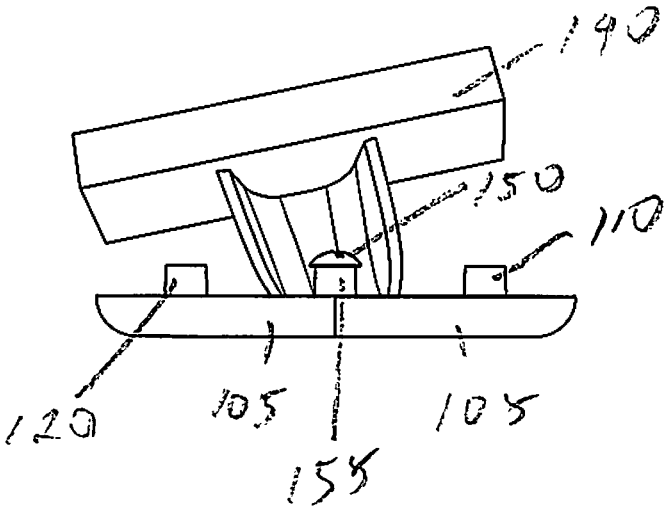
FIG. 9 is a tip of the arm of FIG. 1.

1. blade
5. root/arm end of blade
10. first fastening hole
20. second fastening hole
30. third fastening hole
40. middle hole
100. First Blade Iron with single screw in middle of three posts (two outward).
105. Blade attachment end
110. first post
120. second post
130. third post
150. middle rotatable fastener
155. base
190. motor attachment end
200. Second Blade Iron with single screw in middle of three posts (inward outward).
205. Blade attachment end
210. first post
220. second post
230. third post
250. middle rotatable fastener
255. base
290. motor attachment end
300. Third Blade Iron with single screw and two inward posts.
305. blade attachment end
310. first post
320. second post
350. single rotatable fastener (apex of triangle pattern)
355. base
390. motor attachment end
400. Fourth Blade Iron with single screw and two outward posts.
405. blade attachment end
410. first post
420. second post
450. single rotatable fastener (apex of triangle pattern)
455. base
490. motor attachment end FIG. 1 is a plan view of a single rotatable fastener blade arm 100 having two outward facing posts 110, 120 and one inward post 130 with fan blade 1. FIG. 2 is a top right perspective view of the arm 100 of FIG. 1 FIG. 3 is a top left perspective view of the arm 100 of FIG. 1. FIG. 4 is a top view of the arm 100 of FIG. 1. FIG. 5 is a bottom view of the arm 100 of FIG. 1. FIG. 6 is an upside down side view the arm 100 of FIG. 1. FIG. 7 is a side view of the arm 100 of FIG. 1. FIG. 8 is a root end view of the arm 100 of FIG. 1. FIG. 9 is a tip of the arm 100 of FIG. 1.

Referring to FIGS. 1-9, the novel blade arm 100 can have a blade attachment end 105 for attaching the arm 100 to a ceiling fan blade 1, and a motor attachment end 190 for attaching the arm 100 to a motor on a ceiling fan. The blade attachment end 105 can have three upwardly protruding posts 110, 120, 130 arranged in a triangular configuration with two outward facing posts 110, 120 and one inward facing post 130. Each post 110-130 can have an enlarged base with a narrower upwardly extending tip portion. The blade attachment end 105 of the arm 100 can have middle raised base 155 generally located in the middle of the posts 110, 120 and 130 that can support a single rotatable fastener 150, such as a screw and the like. The rotatable fastener 150 can threadably attach to a threaded opening in the top of the raised base 155.

During installation, the user can remove the rotatable fastener 155 from the raised base 150. The blade attachment end 5 of the ceiling fan blade 1 can be laid over the blade attachment end 105 of the blade arm 105 and lined up so that the top of each of the three posts 110, 120, 130 pass through the holes 10, 20, 30 of the blade 1. The bottom of the arm attachment end 5 of the blade can generally rest on the upper edge portion of the base of each of the posts 110, 120, 130, so that the tip ends of each post 110,120, 130 protrude upward from the top of the arm attachment end 5 of the blade 1. The rotatable fastener can be screwed into the central opening 40 in the arm attachment end 5 of the blade 1 so that outer edges of the enlarged head portion of the rotatable fastener 150 abut against upper surface portion of the top of arm attachment end 5 of the blade 1 to hold the blade to the arm. Each other blade can be attached to respective blade arms in a similar manner until all the blades are attached to all of the arms of the ceiling fan. Each blade can be attached to each arm by only a single rotatable fastener for each blade.

Figure 10:
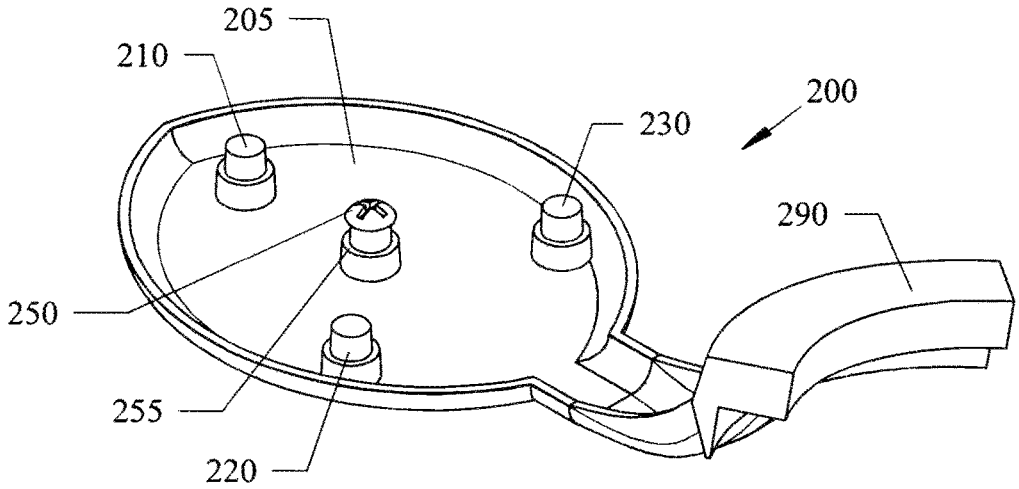
FIG. 10 is a top right perspective view of a single rotatable fastener blade arm with two inward facing posts and one outward post.
Figure 11:
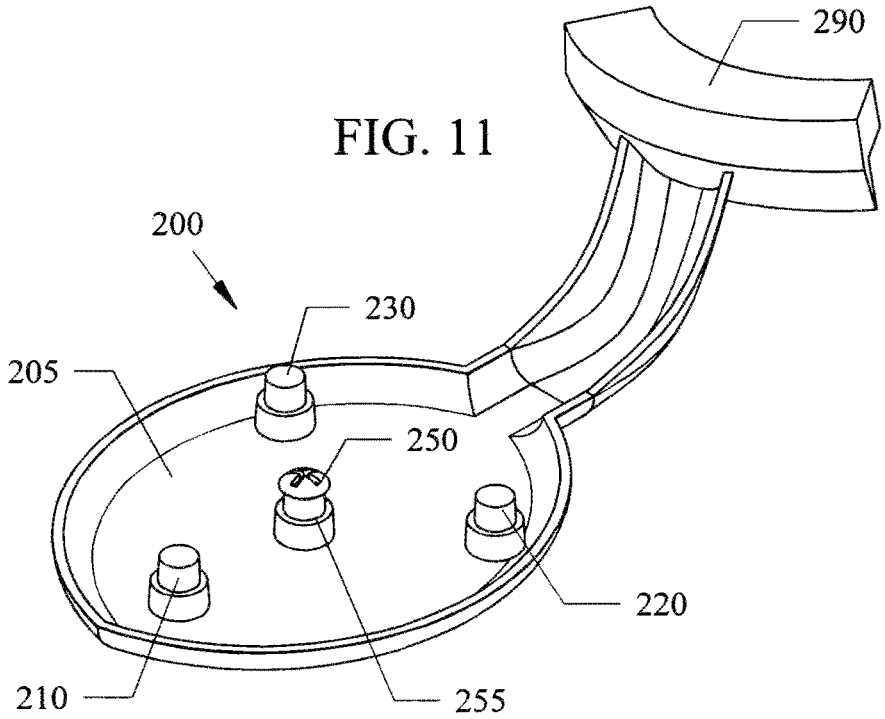
FIG. 11 is a top left perspective view of the arm of FIG. 10.
Figure 12:
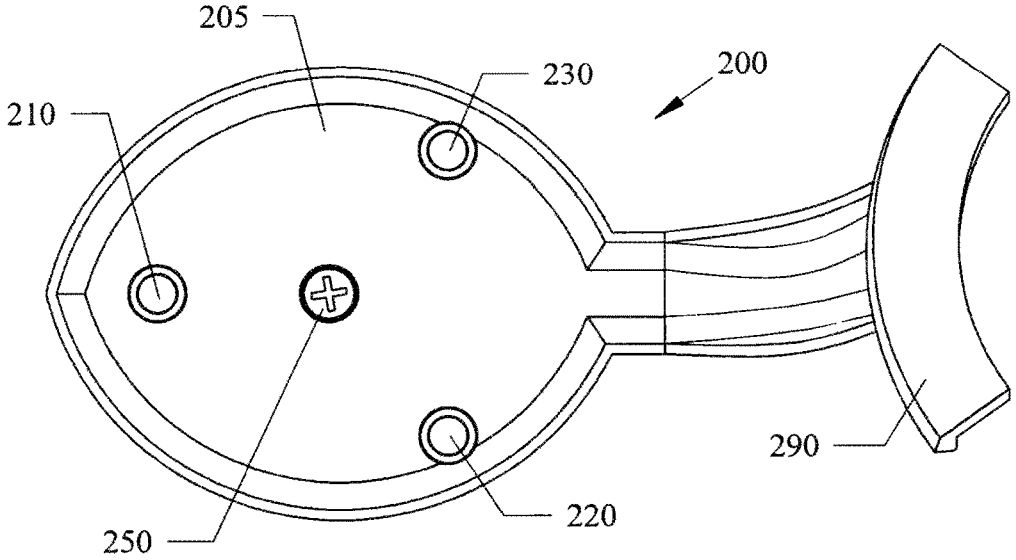
FIG. 12 is a top view of the arm of FIG. 10.
Figure 13:
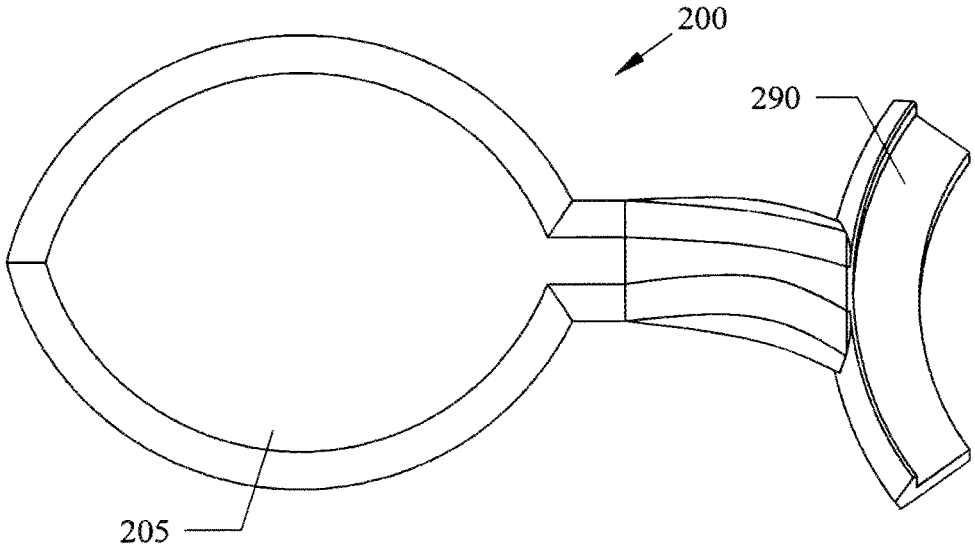
FIG. 13 is a bottom view of the arm of FIG. 10.
Figure 14:
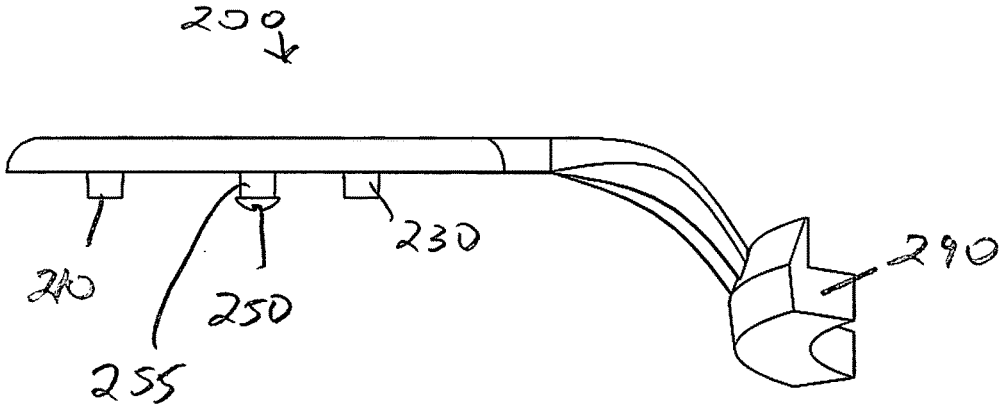
FIG. 14 is an upside down side view the arm of FIG. 10.
Figure 15:
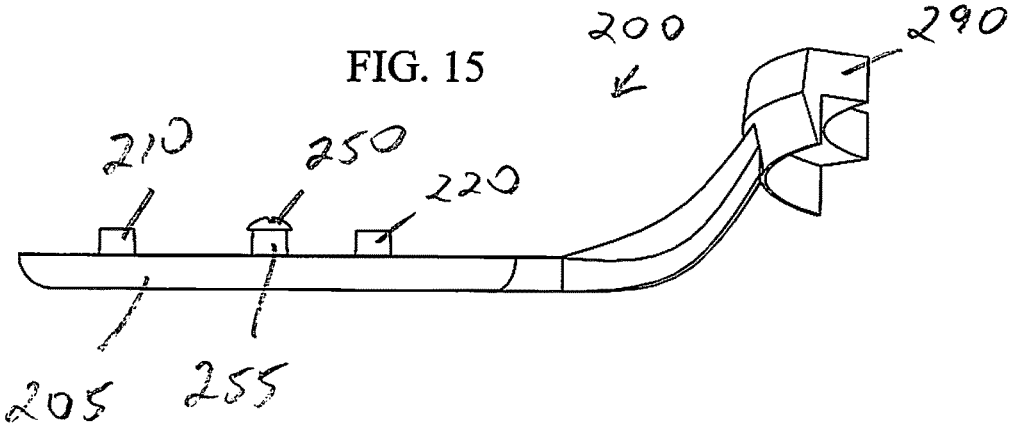
FIG. 15 is a side view of the arm of FIG. 10.
Figure 16:
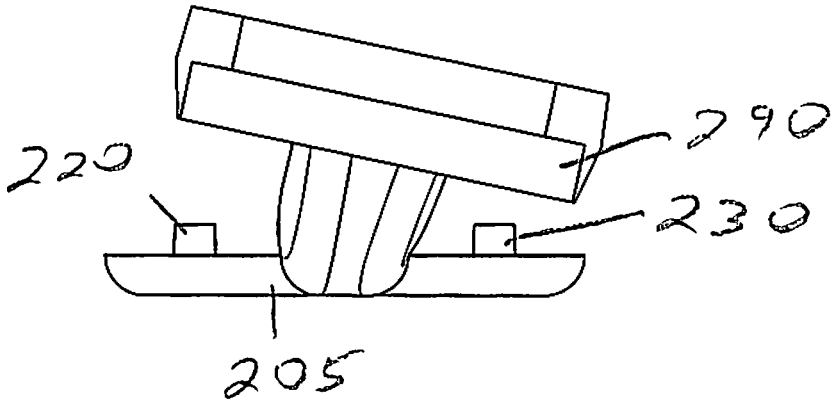
FIG. 16 is a root end view of the arm of FIG. 10.
Figure 17:
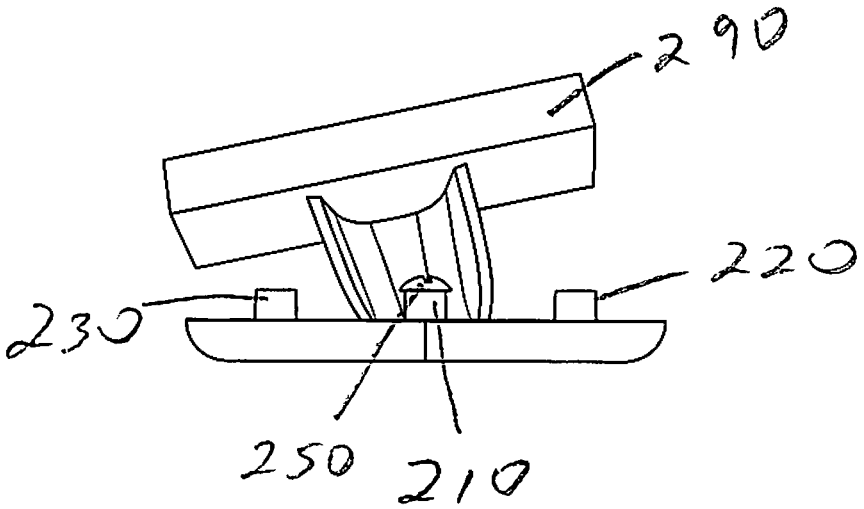
FIG. 17 is a tip end view of the arm of FIG. 1.

FIG. 10 is a top right perspective view of a single rotatable fastener blade arm 200 with two inward facing posts 220, 230 and one outward post 210. FIG. 11 is a top left perspective view of the arm 200 of FIG. 10. FIG. 12 is a top view of the arm 200 of FIG. 10. FIG. 13 is a bottom view of the arm 200 of FIG. 10. FIG. 14 is an upside down side view the arm 200 of FIG. 10. FIG. 15 is a side view of the arm 200 of FIG. 10. FIG. 16 is a root end view of the arm 200 of FIG. 10. FIG. 17 is a tip end view of the arm 200 of FIG. 1.

Referring to FIGS. 10-17, the novel blade arm 200 can have a blade attachment end 205 for attaching the arm 200 to a ceiling fan blade 1, and a motor attachment end 290 for attaching the arm 200 to a motor on a ceiling fan. The blade attachment end 205 can have three upwardly protruding posts 210, 220, 230 arranged in a triangular configuration with one outward facing post 210 and two inward facing posts 220, 230. Each post 210-230 can have an enlarged base with a narrower upwardly extending tip portion. The blade attachment end 205 of the arm 200 can have middle raised base 255 generally located in the middle of the posts 210, 220 and 230 that can support a single rotatable fastener 250, such as a screw and the like. The rotatable fastener 250 can threadably attach to a threaded opening in the top of the raised base 255.

The blade arm 200 can be attached to a blade in a similar manner to the previous embodiment. Here, the blade 1 of the previous embodiment can have a different hole pattern having two inwardly facing through holes and one outwardly facing through hole and central hole for the rotatable fastener 250.

During installation, the user can remove the rotatable fastener 255 from the raised base 250. Similar to the previous embodiment, the blade attachment end of the ceiling fan blade can be laid over the blade attachment end 205 of the blade arm 205 and lined up so that the top of each of the three posts 210, 220, 230 pass through respective holes of the blade. The bottom of the arm attachment end of the blade can generally rest on the upper edge portion of the base of each of the posts 210, 220, 230, so that the tip ends of each post 210, 220, 230 protrude upward from the top of the arm attachment end of the blade.

The rotatable fastener 250 can be screwed into the central opening in the arm attachment end of the blade so that outer edges of the enlarged head portion of the rotatable fastener 250 abut against upper surface portion of the top of arm attachment end of the blade to hold the blade to the arm. Each other blade can be attached to respective blade arms in a similar manner until all the blades are attached to all of the arms of the ceiling fan. Each blade can be attached to each arm by only a single rotatable fastener for each blade.

Figure 18:
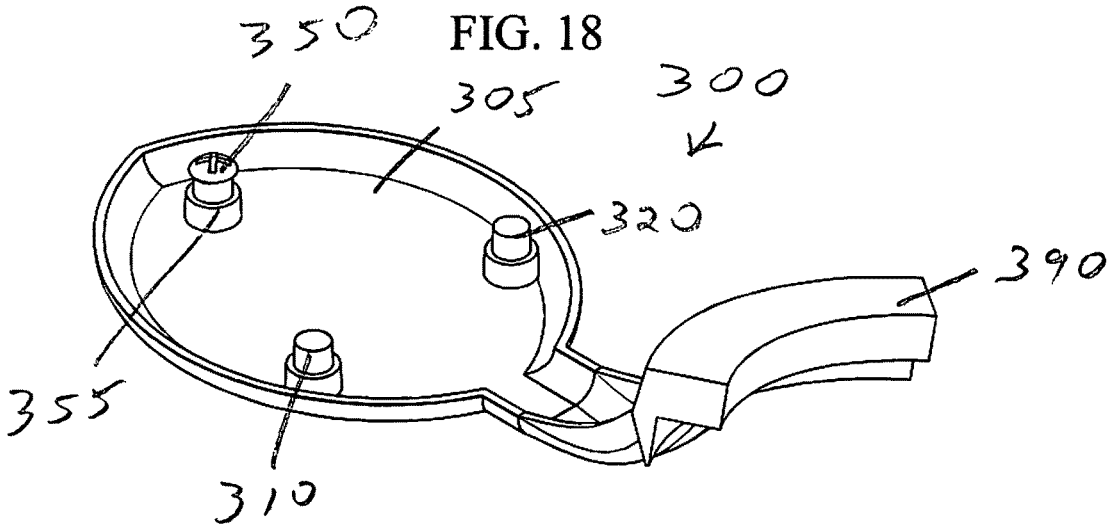
FIG. 18 is a top right perspective view of a single rotatable fastener blade arm with only two inward facing posts.
Figure 19:
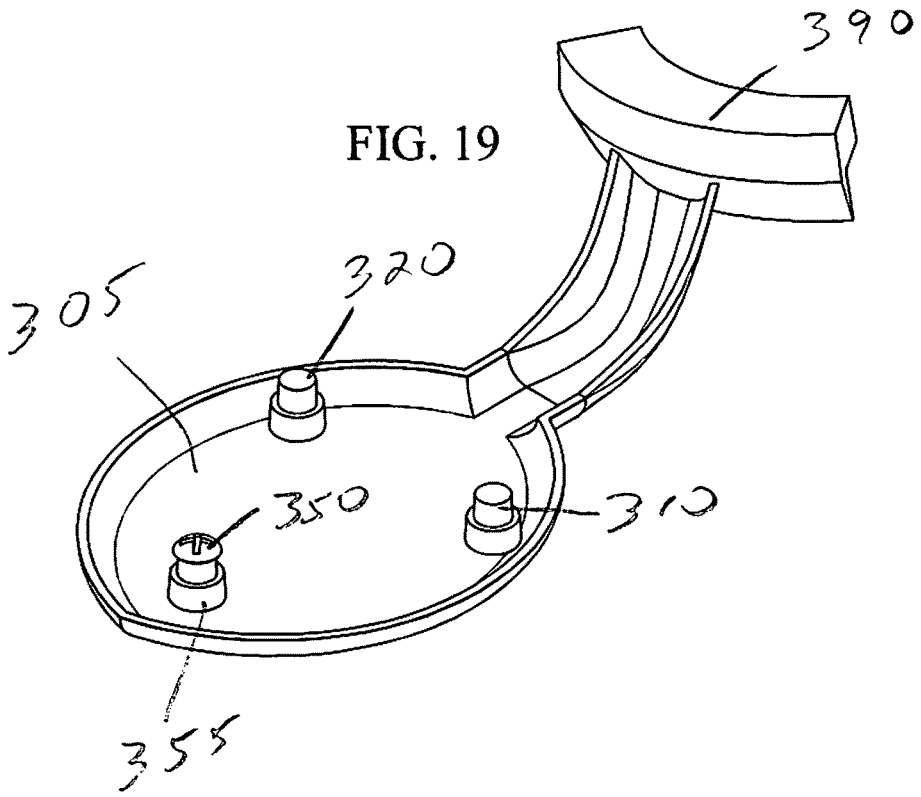
FIG. 19 is a top left perspective view of the arm of FIG. 18.
Figure 20:
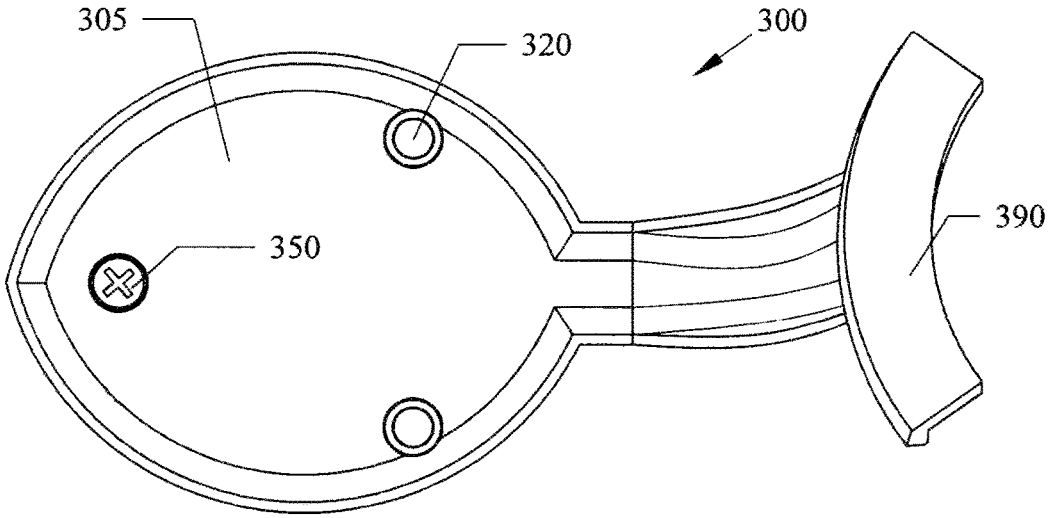
FIG. 20 is a top view of the arm of FIG. 18.
Figure 21:
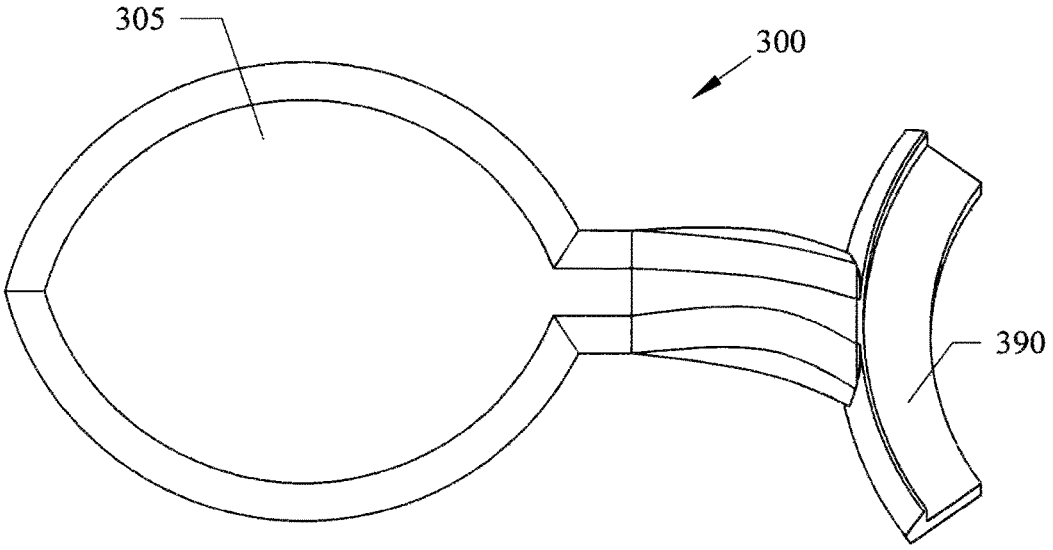
FIG. 21 is a bottom view of the arm of FIG. 18.
Figure 22:
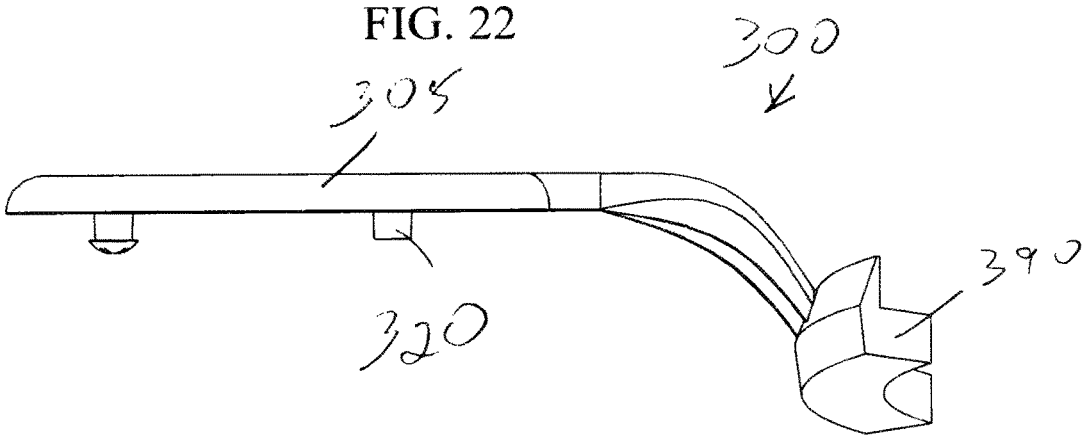
FIG. 22 is an upside down side view of the arm of FIG. 18.
Figure 23:
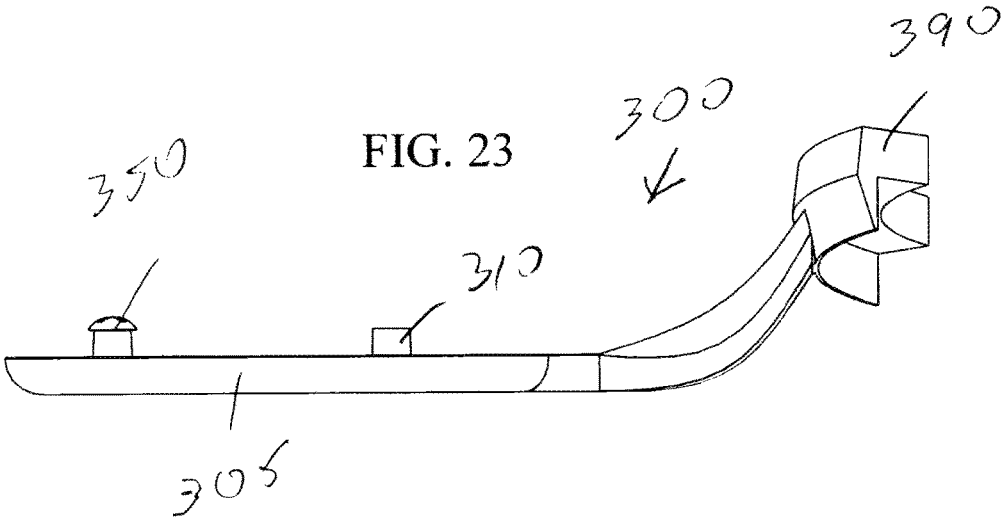
FIG. 23 is a side view of the arm of FIG. 18.
Figure 24:
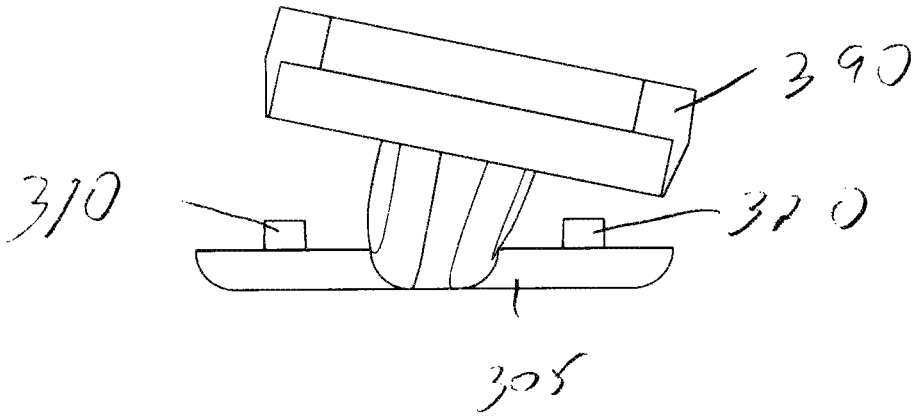
FIG. 24 is a root end view of the arm of FIG. 18.
Figure 25:
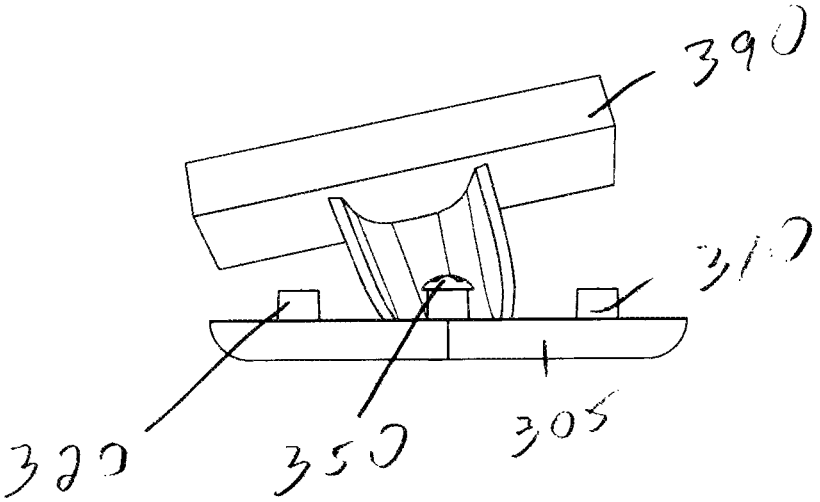
FIG. 25 is a tip end view of the arm of FIG. 18.

FIG. 18 is a top right perspective view of a single screw blade arm 300 with only two inward facing posts 310, 320 and one rotatable fastener (apex of triangle pattern). FIG. 19 is a top left perspective view of the arm 300 of FIG. 18. FIG. 20 is a top view of the arm 300 of FIG. 18. FIG. 21 is a bottom view of the arm 300 of FIG. 18. FIG. 22 is an upside down side view of the arm 300 of FIG. 18. FIG. 23 is a side view of the arm of FIG. 18. FIG. 24 is a root end view of the arm 300 of FIG. 18. FIG. 25 is a tip end view of the arm 300 of FIG. 18.

Referring to FIGS. 18-25, the novel blade arm 300 can have a blade attachment end 305 for attaching the arm 300 to a ceiling fan blade, and a motor attachment end 390 for attaching the arm 300 to a motor on a ceiling fan. The blade attachment end 305 can have two inward facing posts 310, 320 and one outward facing rotatable fastener 350 on a base 355 arranged in a triangular configuration. Each post 310, 320 can have an enlarged base with a narrower upwardly extending tip portion. The blade attachment end 305 of the arm 300 can have outward facing raised base 355 that can support a single rotatable fastener 350, such as a screw and the like. The rotatable fastener 350 can threadably attach to a threaded opening in the top of the raised base 355.

The blade arm 300 can be attached to a blade in a similar manner to the previous embodiment. Here, the blade 1 of the previous embodiment can have a different hole pattern having two outward through holes and one inwardly facing through hole (a total of only three holes).

During installation, the user can remove the rotatable fastener 355 from the raised base 350. Similar to the previous embodiment, the blade attachment end of the ceiling fan blade can be laid over the blade attachment end 305 of the blade arm and lined up so that the top of each of the posts 310, 320 pass through respective holes of the blade. The bottom of the arm attachment end of the blade can generally rest on the upper edge portion of the base of each of the posts 310, 320, so that the tip ends of each post 310, 320 protrude upward from the top of the arm attachment end of the blade.

The rotatable fastener 350 can be screwed into the central opening in the arm attachment end of the blade so that outer edges of the enlarged head portion of the rotatable fastener 350 can abut against upper surface portion of the top of arm attachment end of the blade. Each other blade can be attached to respective blade arms in a similar manner until all the blades are attached to all of the arms of the ceiling fan. Each blade can be attached to each arm by only a single rotatable fastener for each blade.

Figure 26:
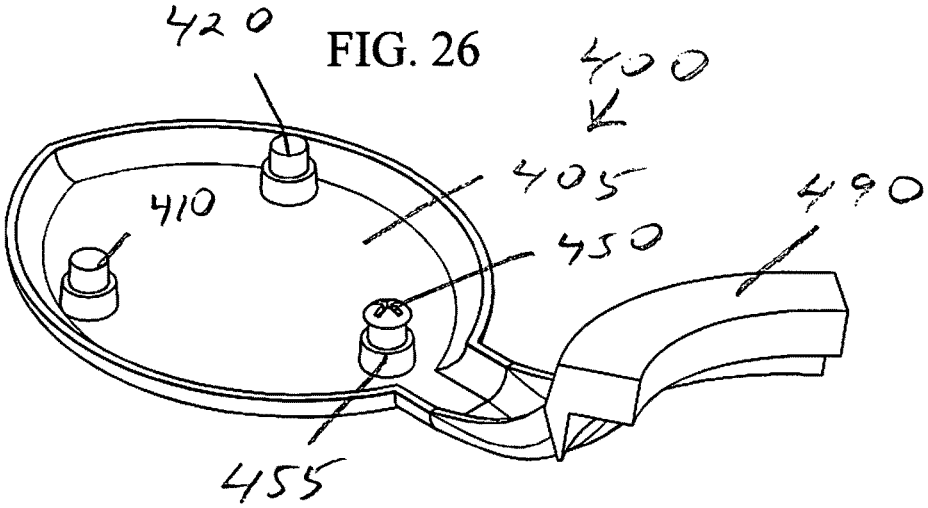
FIG. 26 is a top right perspective view of a single rotatable fastener blade arm with only two outward facing posts.
Figure 27:
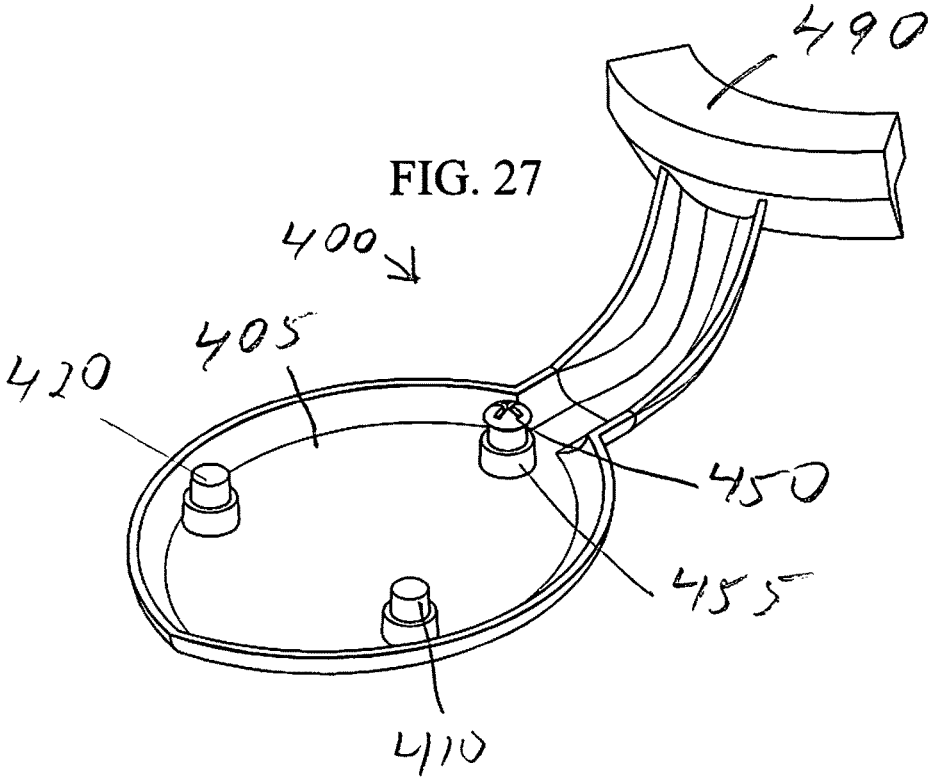
FIG. 27 is a top left perspective view of the arm of FIG. 26.
Figure 28:
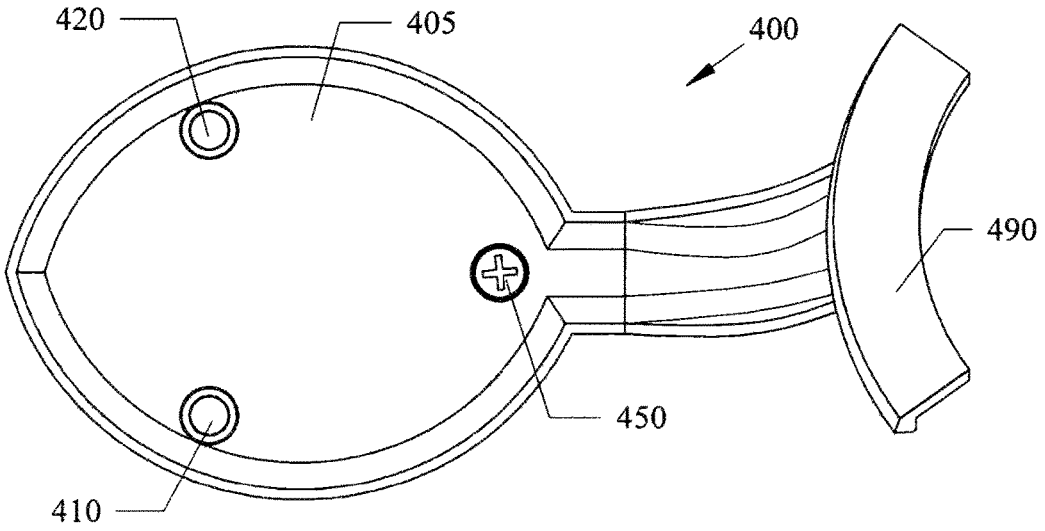
FIG. 28 is a top view of the arm of FIG. 26.
Figure 29:
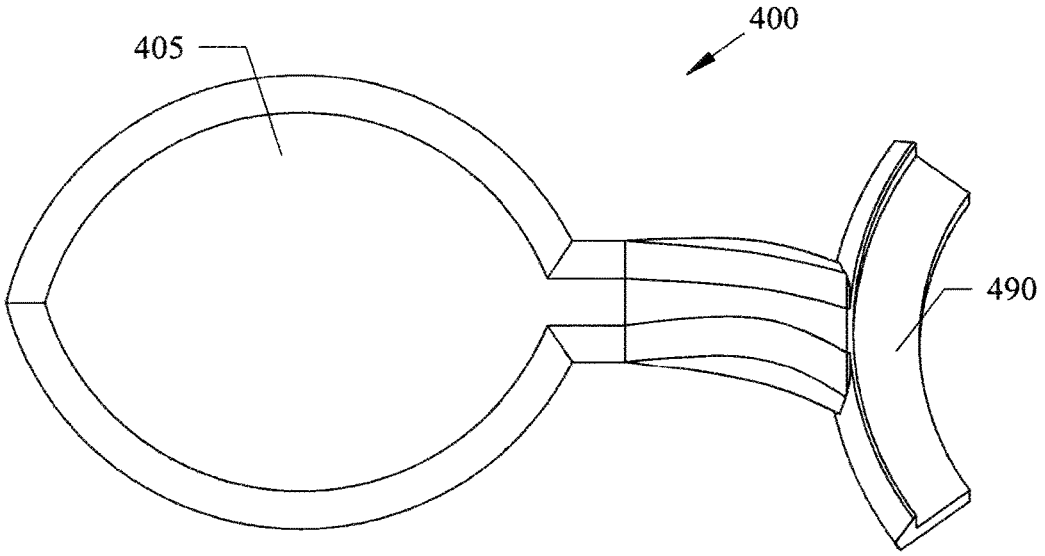
FIG. 29 is a bottom view of the arm of FIG. 26.
Figure 30:
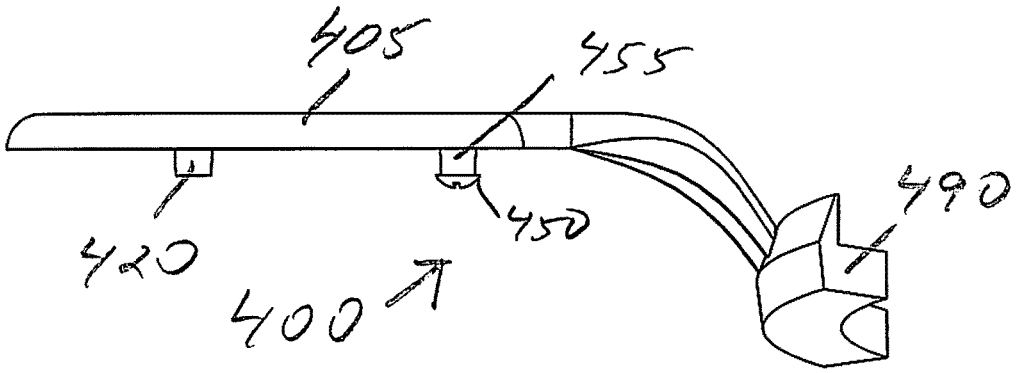
FIG. 30 is an upside down side view of the arm of FIG. 26.
Figure 31:
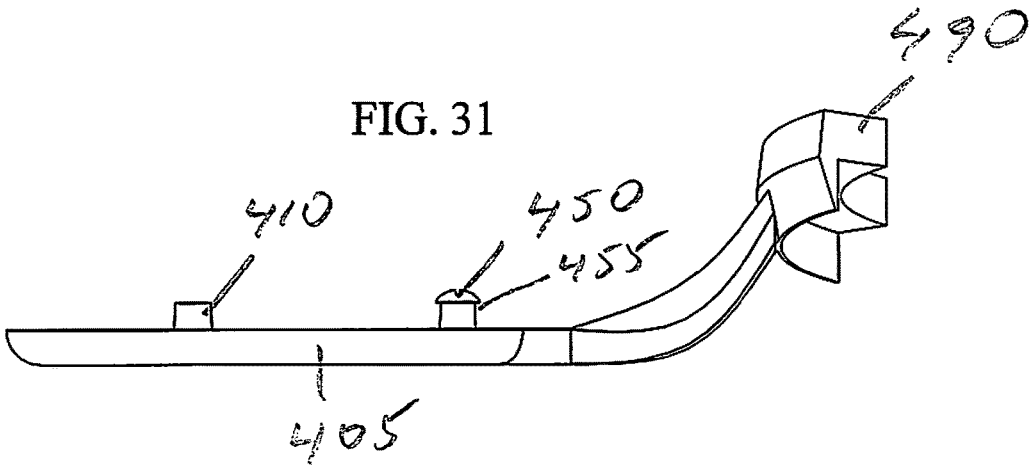
FIG. 31 is a side view of the arm of FIG. 26.
Figure 32:
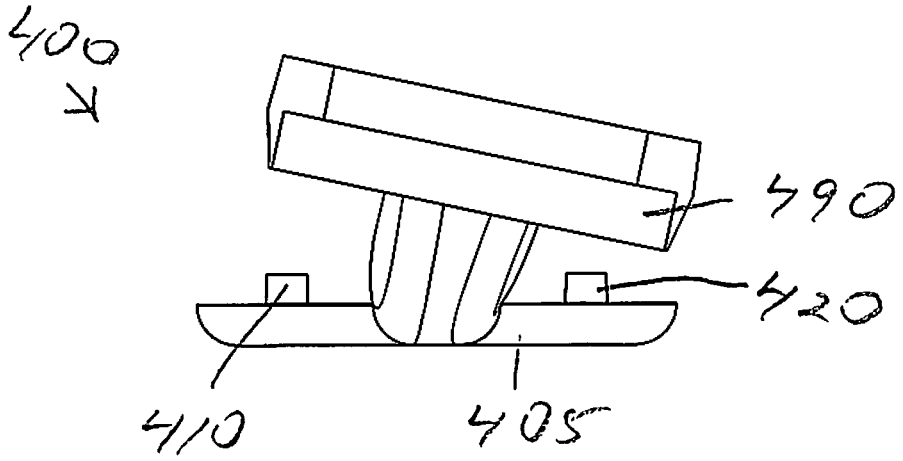
FIG. 32 is a root end view of the arm of FIG. 26.
Figure 33:
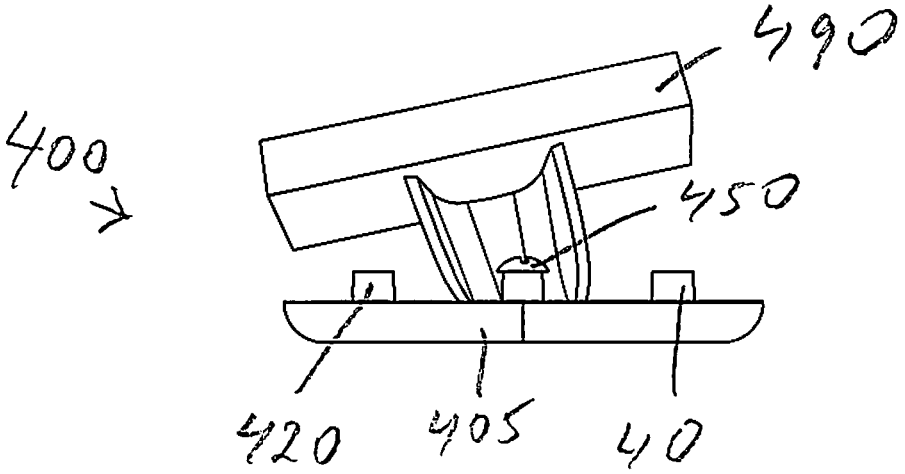
FIG. 33 is a tip end view of the arm of FIG. 26.

FIG. 26 is a top right perspective view of a single rotatable fastener blade arm 400 with only two outward facing posts 410, 420 and one inwardly facing single rotatable fastener 450. FIG. 27 is a top left perspective view of the arm 400 of FIG. 26. FIG. 28 is a top view of the arm 400 of FIG. 26. FIG. 29 is a bottom view of the arm 400 of FIG. 26. FIG. 30 is an upside down side view of the arm 400 of FIG. 26. FIG. 31 is a side view of the arm 400 of FIG. 26. FIG. 32 is a root end view of the arm 400 of FIG. 26. FIG. 33 is a tip end view of arm 400 of FIG. 26.

Referring to FIGS. 26-33, the novel blade arm 400 can have a blade attachment end 405 for attaching the arm 400 to a ceiling fan blade, and a motor attachment end 490 for attaching the arm 400 to a motor on a ceiling fan. The blade attachment end 405 can have two outward facing posts 410, 420 and one inward facing rotatable fastener 450 on a base 455 arranged in a triangular configuration. Each post 410, 420 can have an enlarged base with a narrower upwardly extending tip portion. The blade attachment end 405 of the arm 400 can have inward facing raised base 455 that can support a single rotatable fastener 450, such as a screw and the like. The rotatable fastener 450 can threadably attach to a threaded opening in the top of the raised base 455.

The blade arm 400 can be attached to a blade in a similar manner to the previous embodiment. Here, the blade of the previous embodiment can have a different hole pattern having two inward through holes and one outward facing through hole (a total of only three holes).

During installation, the user can remove the rotatable fastener 455 from the raised base 450. Similar to the previous embodiment, the blade attachment end of the ceiling fan blade can be laid over the blade attachment end 405 of the blade arm and lined up so that the top of each of the posts 410, 420 pass through respective holes of the blade. The bottom of the arm attachment end of the blade can generally rest on the upper edge portion of the base of each of the posts 410, 420, so that the tip ends of each post 410, 420 protrude upward from the top of the arm attachment end of the blade.

The rotatable fastener 450 can be screwed into the central opening in the arm attachment end of the blade so that outer edges of the enlarged head portion of the rotatable fastener 450 can abut against upper surface portion of the top of arm attachment end of the blade. Each other blade can be attached to respective blade arms in a similar manner until all the blades are attached to all of the arms of the ceiling fan. Each blade can be attached to each arm by only a single rotatable fastener for each blade.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. A ceiling fan blade arm, consisting of: a motor attachment end adapted to be attached to a portion of a ceiling fan motor; a blade attachment end adapted to be attached to a root end of a ceiling fan blade; only one single rotatable fastener with an enlarged head mountable to a cylindrical fastener base; and only two cylindrical alignment posts, each of the posts consisting of a cylindrical upper extent with an upper diameter disposed on top of a cylindrical post base, the cylindrical post base having a larger diameter than the upper diameter of the cylindrical upper extent, the top of each cylindrical post base having an exposed upper perimeter edge, the cylindrical upper extent and the cylindrical post base being monolithically formed together, wherein the only one single rotatable fastener with the cylindrical fastener base and the only two cylindrical alignment posts form a triangular configuration with the only one rotatable fastener with the cylindrical base forming an apex of the triangular configuration and the only two cylindrical alignment posts forming a base of the triangular configuration, wherein the cylindrical fastener base and the only two cylindrical alignment posts are adapted to pass into three circular through-holes on the root end of the ceiling fan blade and only the enlarged head of the rotatable fastener being screwed into the cylindrical fastener base so that the exposed upper perimeter edge of each cylindrical post base of each alignment post and outer edges of the cylindrical fastener base abut and rest against a bottom surface portion of the root end of the ceiling fan blade, in order to attach the ceiling fan blade to the blade attachment end of the ceiling fan blade arm.

2. The blade arm of claim 1 wherein the only one single rotatable fastener with the enlarged head is a screw.

3. The blade arm of claim 1, wherein the only two cylindrical alignment posts are positioned inward facing from the blade attachment end and the only one single rotatable fastener with the enlarged head on the cylindrical fastener base is positioned outward facing, wherein the two cylindrical alignment posts and the rotatable fastener with the enlarged head on the cylindrical fastener base form a triangular arrangement.

4. The blade arm of claim 3, wherein the only one single rotatable fastener with the enlarged head is a screw.

5. The blade arm of claim 1, wherein the only two cylindrical alignment posts are positioned outward facing from the blade attachment end and the only one single rotatable fastener with the enlarged head on the cylindrical fastener base is positioned inward facing, wherein the two cylindrical alignment posts and the rotatable fastener with the enlarged head on the cylindrical fastener base form a triangular arrangement.

6. The blade arm of claim 5, wherein the only one single rotatable fastener with the enlarged head is a screw.

7. A ceiling fan blade attachment system consisting of: a plurality of blade arms, each blade arm consisting of a motor attachment end adapted to be attached to a portion of a ceiling fan motor and a blade attachment end having only one single rotatable fastener with an enlarged head mountable on a cylindrical fastener base and only two cylindrical alignment posts, each of the posts consisting of a cylindrical upper extent with an upper diameter disposed on top of a cylindrical post base, the cylindrical post base having a larger diameter than the upper diameter of the cylindrical upper extent, the top of each cylindrical post base having an exposed upper perimeter edge, each cylindrical upper extent and each cylindrical post base being monolithically formed together, wherein the single rotatable fastener with the enlarged head on the cylindrical fastener base and the two cylindrical alignment posts form a triangular configuration with the one rotatable fastener with the enlarged head on the cylindrical fastener base forming an apex of the triangular configuration and the two cylindrical alignment posts forming a base of the triangular configuration; and a plurality of fan blades, each blade consisting of three circular through-holes on a root end of the blade, wherein the cylindrical fastener base and the two cylindrical alignment posts are adapted to pass into the three circular through-holes on the root ends of the blades, so that the exposed upper perimeter edge of each cylindrical post base of each alignment post and outer edges of the cylindrical fastener base abut and rest against a bottom surface portion of the root end of the fan blade, and the rotatable fastener with the enlarged head being screwed into the cylindrical fastener base.

8. The ceiling fan blade attachment system of claim 7, wherein the only two cylindrical posts are positioned inward facing from each blade attachment end and the only one single rotatable fastener with the enlarged head on the cylindrical fastener base is positioned outward facing.

9. The ceiling fan blade attachment system of claim 7, wherein the only two cylindrical alignment posts are positioned outward facing from each blade attachment end and the only one single rotatable fastener with the enlarged head on the cylindrical fastener base is positioned inward facing.

10. The ceiling fan blade attachment system of claim 7, wherein each of the only one single rotatable fasteners with the enlarged head is a screw.

11. A ceiling fan blade arm, consisting of: a motor attachment end adapted to be attached to a portion of a ceiling fan motor; a blade attachment end adapted to be attached to a root end of a ceiling fan blade; only one single rotatable fastener with an enlarged head mountable to a cylindrical fastener base; and a plurality of cylindrical alignment posts, each of the posts consisting of a cylindrical upper extent with an upper diameter disposed on top of a cylindrical post base, the cylindrical post base having a larger diameter than the upper diameter of the cylindrical upper extent, the top of each cylindrical post base having an exposed upper perimeter edge, each cylindrical upper extent and each cylindrical post base being monolithically formed together, wherein the cylindrical fastener base and the cylindrical alignment posts are adapted to pass into circular through-holes on the root end of the ceiling fan blade and the enlarged head of the rotatable fastener being screwed into the cylindrical fastener base so that the exposed upper perimeter edge of each cylindrical post base of each alignment post and outer edges of the cylindrical fastener base abut and rest against a bottom surface portion of the root end of the ceiling fan blade.

12. A ceiling fan blade attachment system consisting of: a plurality of blade arms, each blade arm consisting of a motor attachment end adapted to be attached to a portion of a ceiling fan motor and a blade attachment end having only one single rotatable fastener with an enlarged head mountable on a cylindrical fastener base and a plurality of cylindrical alignment posts, each of the posts consisting of a cylindrical upper extent with an upper diameter disposed on top of a cylindrical post base, the cylindrical post base having a larger diameter than the upper diameter of the cylindrical upper extent, the top of each cylindrical post base having an exposed upper perimeter edge, each cylindrical upper extent and each cylindrical post base being monolithically formed together; and a plurality of fan blades, each blade consisting of a plurality of through-holes on a root end of the blade, wherein the cylindrical fastener base and the cylindrical alignment posts are adapted to pass into the through-holes on the root ends of the blades, so that the exposed upper perimeter edge of each cylindrical post base of each alignment post and outer edges of the cylindrical fastener base abut and rest against a bottom surface portion of the root end of the ceiling fan blade, and the rotatable fastener with the enlarged head being screwed into the cylindrical fastener base.

* * * * *